US007032671B2

(12) United States Patent
Aud

(10) Patent No.: US 7,032,671 B2
(45) Date of Patent: Apr. 25, 2006

(54) METHOD FOR INCREASING FRACTURE PENETRATION INTO TARGET FORMATION

(75) Inventor: William W. Aud, Littleton, CO (US)

(73) Assignee: Integrated Petroleum Technologies, Inc., Golden, CO (US)

( * ) Notice: Subject to any disclaimer, the term of this patent is extended or adjusted under 35 U.S.C. 154(b) by 0 days.

(21) Appl. No.: 10/396,915

(22) Filed: Mar. 25, 2003

(65) Prior Publication Data

US 2004/0211567 A1 Oct. 28, 2004

Related U.S. Application Data

(60) Provisional application No. 60/432,784, filed on Dec. 12, 2002.

(51) Int. Cl.
*E21B 43/26* (2006.01)

(52) U.S. Cl. ..... 166/308.1; 166/250.1; 166/297

(58) Field of Classification Search ..... 166/308.1, 166/250.1, 297
See application file for complete search history.

(56) References Cited

U.S. PATENT DOCUMENTS 3,700,032 A * 10/1972 Terry et al. ..... 166/283
4,005,750 A 2/1977 Shuck
4,478,282 A * 10/1984 Nolte et al. ..... 166/281
4,509,598 A 4/1985 Earl et al.
4,515,214 A 5/1985 Fitch et al.
4,687,061 A 8/1987 Uhri
4,714,115 A * 12/1987 Uhri ..... 166/308.1
4,867,242 A 9/1989 Hart
4,869,322 A 9/1989 Vogt, Jr. et al.
4,887,670 A * 12/1989 Lord et al. ..... 166/281
5,018,578 A * 5/1991 El Rabaa et al. ..... 166/281
5,111,881 A 5/1992 Soliman et al.
5,372,195 A 12/1994 Swanson et al.
5,482,116 A 1/1996 El-Rabaa et al.
5,531,274 A 7/1996 Bienvenu, Jr.

* cited by examiner

*Primary Examiner*—David Bagnell
*Assistant Examiner*—Giovanna M. Collins
(74) *Attorney, Agent, or Firm*—Cochran Freund & Young LLC; James R. Young

(57) ABSTRACT

A method of propagating a fracture farther from a well-bore into an oil and/or gas-bearing zone of a target formation while inhibiting growth of the fracture into an adjacent water-bearing zone under or over the oil and/or gas-bearing zone, comprises creating a zone of increased in-situ stress a vertical distance adjacent a target interval and then creating a main fracture in the target interval by, for example, fracturing the target interval with enough fracture fluid and pressure to propagate the main fracture, inter alia, vertically to the zone of increased in-situ stress. When vertical growth of the main fracture reaches the limit set by the zone of increased stress, additional fracture fluid pumped into the target interval tends not to propagate the main fracture vertically beyond that limit and, instead, tends to propagate the main fracture more laterally and farther from the well. Such zone(s) of increased in-situ stress can be created above, below, or both above and below the target interval.

25 Claims, 6 Drawing Sheets

METHOD FOR INCREASING FRACTURE PENETRATION INTO TARGET FORMATION

RELATED PATENT APPLICATIONS

This patent application claims the benefit of U.S. Provisional Application No. 60/432,784, filed on Dec. 12, 2002, which is incorporated herein by reference.

BACKGROUND OF THE INVENTION

1. Field of the Invention

This invention pertains generally to fracturing of oil and gas bearing and other geological formations, and, more specifically, to a method of extending fracture geometry farther into a target formation by increasing in-situ stress in adjacent formations or in adjacent portions of the same formation.

2. Brief Description of the Prior Art

When wells are drilled into geological rock formations for the purpose of producing oil, gas, or water from such formations or for other purposes, such as injection of fluids into the formation, mining, and the like, hydraulic fracturing is a primary method for increasing fluid production or injection rates. In general, one way to fracture a formation is to pump a fluid down a casing or tubing in a well and into the target formation at a sufficiently high pressure and injection rate to overcome in-situ stresses and force a fracture to open and propagate in the formation. Such hydraulically induced fractures, often called "hydraulic fractures" or just "fractures", usually extend in a substantially vertical plane in radially opposite directions from the well-bore, although unique in-situ stress conditions in particular formations can cause different fracture orientation. When the fracture is opened and propagated in the formation, an additional and/or different medium is usually pumped into the fracture, to extend the benefits of the fracture over a long term after the fracturing fluid pump and pressure is stopped, such as a proppant material to keep the fracture open or an acid to dissolve minerals from the fracture walls to produce a conductive pathway along the fracture after it is closed. Consequently, in fractured oil and gas bearing formations, the oil and gas can flow more easily via the fracture to the well. Likewise in fractured fluid injection formations, fluid can flow more easily from the fluid injection well into the formation via the fracture. Fractures can also be formed in other ways, such as with explosives or gas, but hydraulic fracturing is by far the most common fracturing technique.

In moderate to low permeability formations, the farther the fracture extends from the well into the target formation, the better the level of stimulation and associated production response. However, in many hydraulic fracturing operations, the fracture geometry exhibits growth in undesirable directions, which, as some have hypothesized, tend to follow the direction perpendicular to the least in-situ tectonic compressive stress in the formation, i.e., usually in a vertical projection along a plane parallel to the maximum, naturally occurring (tectonic) compressive stress field. Several patents, including U.S. Pat. No. 4,005,750 issued to L. Shuck, U.S. Pat. No. 4,687,061 issued to D. Uhri, U.S. Pat. No. 5,111,881 issued to Soliman et al., and U.S. Pat. No. 5,482,116 issued to El-Rabaa et al., illustrate several techniques for modifying in-situ stress fields in localized areas around the well bore to change the initiation and propagation direction of hydraulically induced fractures to extend in other desired directions, even perpendicular to the typical fracture direction in the naturally occurring (tectonic) compressive stress field. Generally, these techniques involve first creating and propping open ordinary fractures that extend parallel to the maximum naturally occurring (tectonic) compressive stress field, which increases the in-situ stress proximate to that fracture, and then creating another fracture that initiates and propagates in a different direction away from such increased stress fields. The U.S. Pat. No. 4,869,322 issued to Vogt, Jr. et al. uses a similar technique to obtain a vertical fracture in unusual formations that favor propagation of horizontal fractures.

Besides influencing propagation direction of hydraulic fractures, however, an equally important goal is to get the fractures to extend as far as possible from the well bore into the formation. U.S. Pat. No. 4,515,214 issued to Fitch et al. and U.S. Pat. No. 4,509,598 issued to Earl et al. address this problem by injecting proppant of a carefully determined density into a fracture with low viscosity fluids (i.e., slurry mix) to screen out the slurry mix and pack or seal marginal edges or tips of fractures. The theory is that a lower density proppant packs upper edges and a higher density proppant packs lower edges or tips of the fracture, thus inhibits growth of the fracture in the directions of such packed edges or tips, e.g., upwardly or downwardly, and thereby forcing continued lateral propagation farther away from the well bore and into the target formation. However, these procedures have had only limited success in the oil and gas industry, perhaps because the lower and upper fracture tip growth is not really slowed to any significant extent by this technique in many fracture operations.

Efforts have also been made to use reduced injection rates or lower viscosity fluids to reduce net fracturing pressure below the pressures required to propagate fractures in adjacent formations with the hope that the fracture would stay in the target formation. However, many rock types have similar tensile strengths and fracture at similar pressure levels, regardless of injection rate and viscosity, thereby limiting any benefits from this technique.

SUMMARY OF THE INVENTION

Accordingly, an object of this invention is to provide a better and more reliable method of propagating a fracture farther from the well-bore into a target formation.

Another object of this invention is to provide a method of propagating a fracture farther from a well-bore into an oil and/or gas-bearing zone of a target formation while inhibiting growth of the fracture into an adjacent water-bearing zone under or over the oil and/or gas-bearing zone.

Additional objects, advantages, and novel features of this invention are set forth in the description and examples below, and others will become apparent to persons skilled in the art upon examination of the following specification or may be learned by practicing the invention. The objects and advantages of the invention may be realized and attained by the instrumentalities, combinations, compositions, or methods particularly included in the appended claims.

To achieve the foregoing and other objects in accordance with the purposes of the invention, as embodied and described herein, the methods of this invention comprise creating a zone of increased in-situ stress in a vertical distance adjacent a target interval of a target oil, gas, or other type formation and then creating a main fracture in the target interval by fracturing the target interval, such as by hydraulic fracturing with more than enough fracture fluid and pressure to propagate the main fracture, inter alia, vertically to the zone of increased in-situ stress. In other words, the zone of increased stress is positioned close enough to the target interval so that the zone of increased stress effectively sets a vertical growth limit on the main fracture. Then, when vertical growth of the main fracture reaches that limit, additional fracture fluid pumped into the target interval tends not to propagate the main fracture vertically beyond that limit and, instead, tends to propagate the main fracture more laterally and farther from the well. Such zone(s) of increased in-situ stress can be created above, below, or both above and below the target interval according to this invention.

A zone of increased in-situ stress according to this invention is preferably created by creating a fracture adjacent the well in the formation(s) where the zone(s) of increased in-situ stress is to be located, sometimes referred to herein as a "barrier fracture". The barrier fracture causes the zone of increased in-situ stress around the barrier fracture, so placement of the barrier fracture in a position to place the zone of increased in-situ stress at the desired vertical growth limit for the main fracture will depend to some extent on the size of the barrier fracture. In general, the barrier fracture may be smaller in size than the main fracture.

The barrier fracture(s) can be created simultaneously with the main fracture or before the main fracture. Simultaneous creation of the main fracture with the barrier fracture(s) can be done by proportionate sizing of the respective perforation sets to inject more fracture fluid into the target interval to create and propagate the larger main fracture than into the adjacent formation(s) to create and propagate the smaller barrier fracture(s). On the other hand, if a barrier fracture is created before the main fracture, it is kept open to maintain the increased in-situ stress zone around the barrier fracture while the main fracture is created and propagated later. An optional squeeze operation in the barrier fracture can increase the in-situ stress around the barrier fracture to even higher levels to act as an even more effective vertical growth limit to the main fracture.

A barrier fracture can also be created in the same target formation as the main fracture. For example, if the target interval is only a portion of the target formation, one or more barrier fracture(s) in the target formation above and/or below the target interval may be used to induce propagation of the main fracture farther laterally from the well. Also, if the target interval is in an oil and/or gas-bearing zone of the target formation above or below a water-bearing zone, a barrier fracture with its surrounding zone of increased in-situ stress in the water-bearing zone can inhibit vertical growth of the main fracture into the water-bearing zone according to this invention.

BRIEF DESCRIPTION OF THE DRAWINGS

The accompanying drawings, which are incorporated herein and form a part of the specification, illustrate preferred embodiments of this invention, and, together with the description, serve to explain the principles of the invention. In the drawings.

DETAILED DESCRIPTION OF THE PREFERRED EMBODIMENTS

Figure 1:
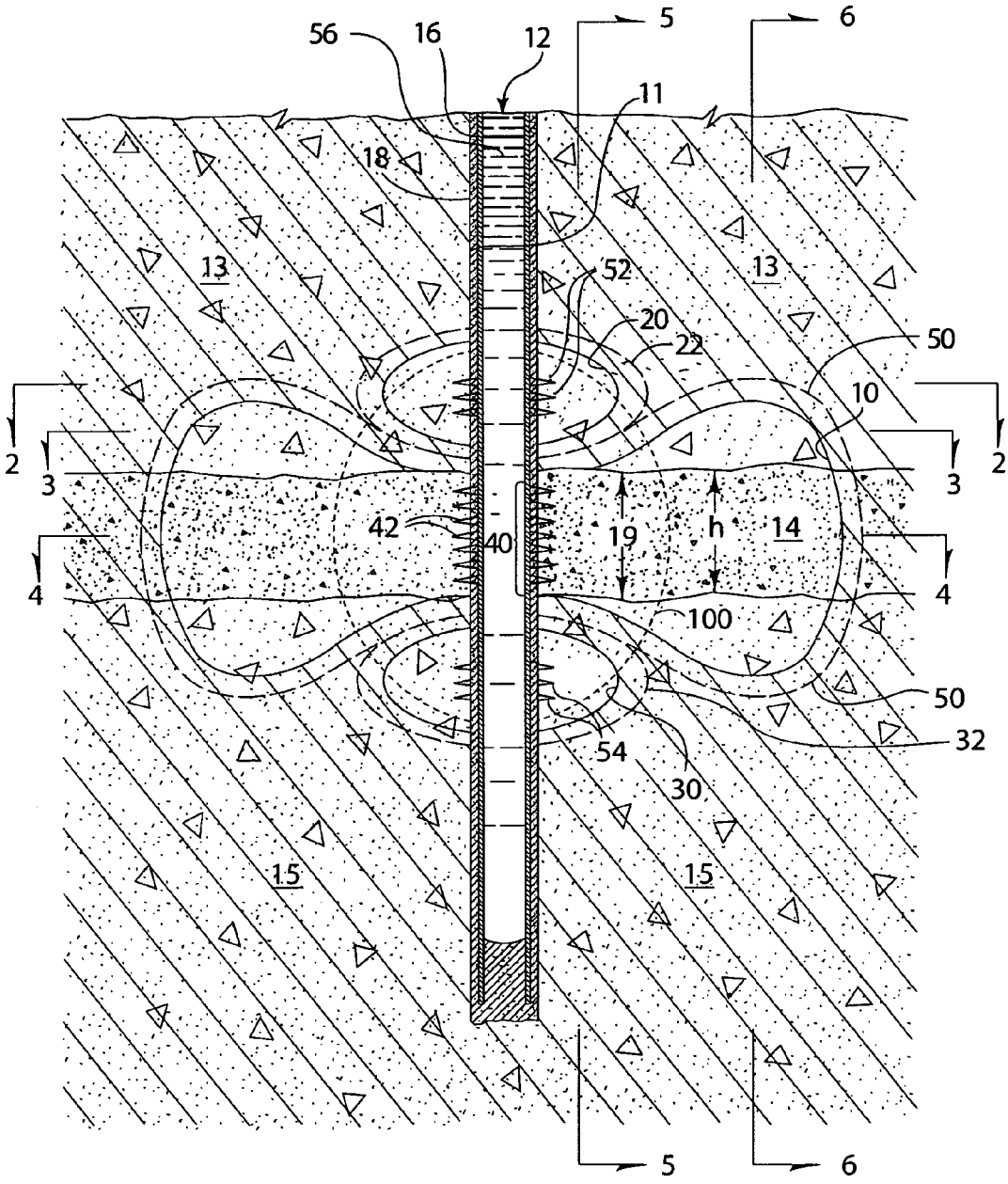
FIG. 1 is a diagrammatic, cross-sectional view of a localized geological area around a well that has undergone hydraulic fracture treatment according to this invention.

A fractured zone 10 propagated from a well 12 into a target formation 14 is illustrated diagrammatically in FIG. 1. This fractured zone 10 is sometimes referred to in this description as the "main fracture zone" or simply the "main fracture". Of course, the relative sizes and dimensions of the main fracture zone 10, well 12, target formation 14, and other structures portrayed in FIG. 1 are not drawn to scale or to proper proportions, which would be impractical, but persons skilled in the art will understand the concepts and features illustrated in FIG. 1 and described herein. Essentially, FIG. 1 is a vertical cross-sectional view of an area around a well 12 drilled and completed into the target formation 14, with the cross-sectional view in a generally vertical plane that includes the well 12 and extends generally parallel to the maximum, naturally occurring (tectonic) compressive stress field, thus, is also co-planar with the projection of the fractured zone 10. Hydraulic fracturing is the most common current fracturing technique, so this description will use hydraulic fracturing as the preferred example implementation of the invention. However, fracturing can also be done with explosives or gas, and other fracturing techniques could be developed in the future, all of which can be used in this invention.

Figure 3:
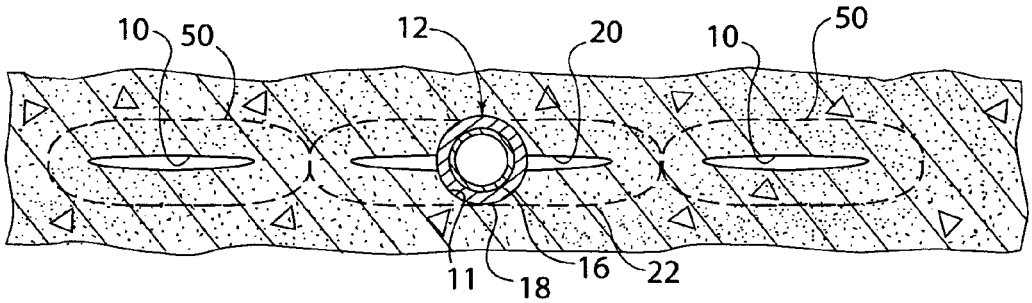
FIG. 3 is a cross-sectional, top plan view of the localized geological area around the well taken along section line 3—3 of FIG. 1.
Figure 4:
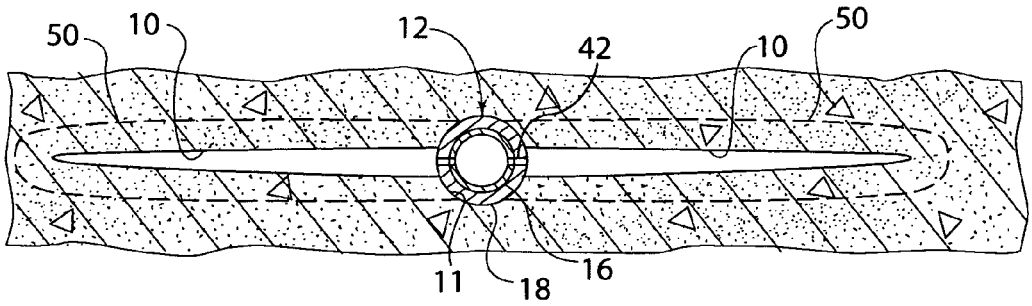
FIG. 4 is a cross-sectional top plan view of the localized geological area around the well taken along section line 4—4 of FIG. 1.
Figure 5:
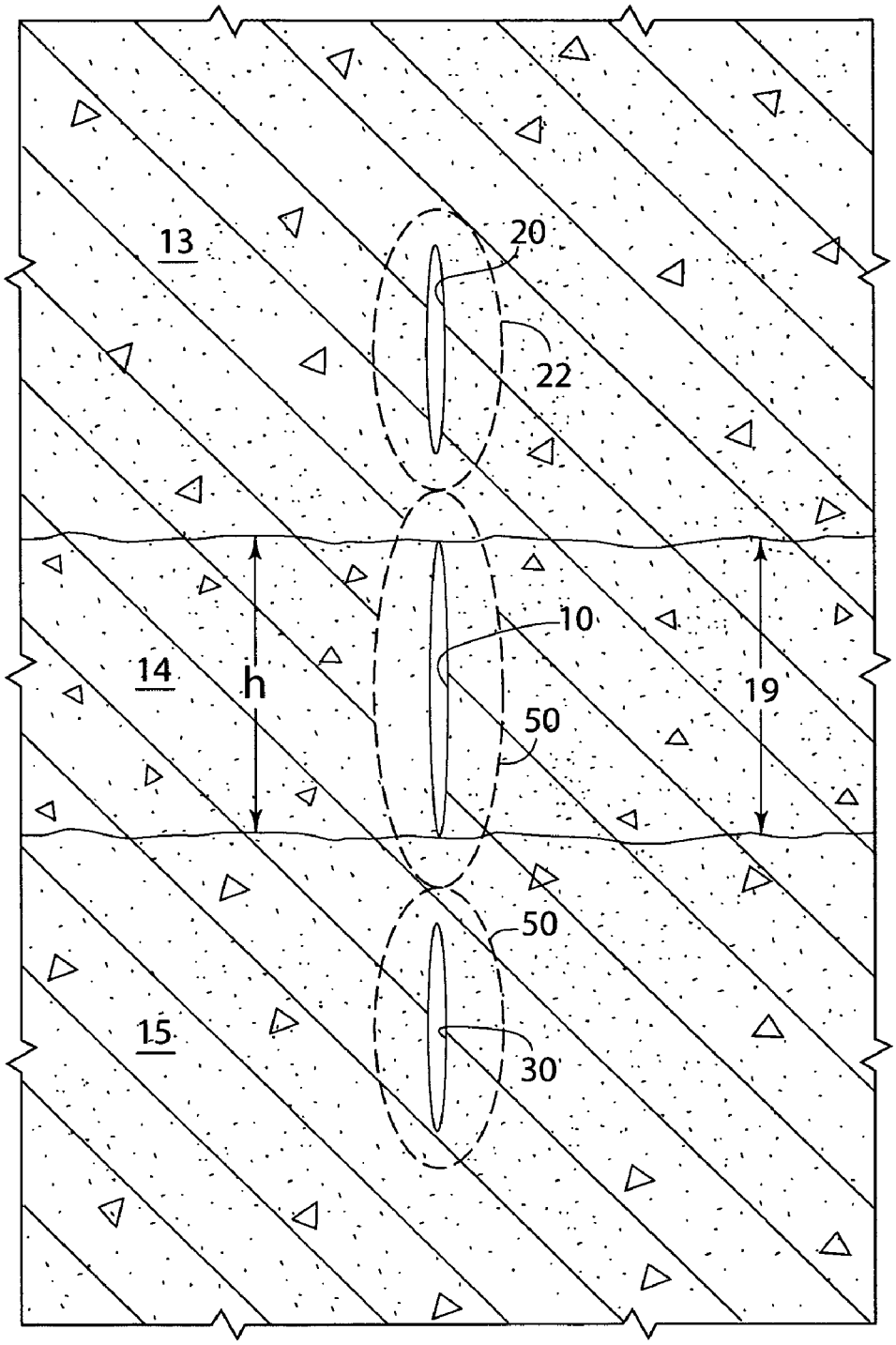
FIG. 5 is an idealistic cross-sectional elevation view of the localized geological area and barrier and main fractures of this invention taken along section line 5—5 of FIG. 1.
Figure 6:
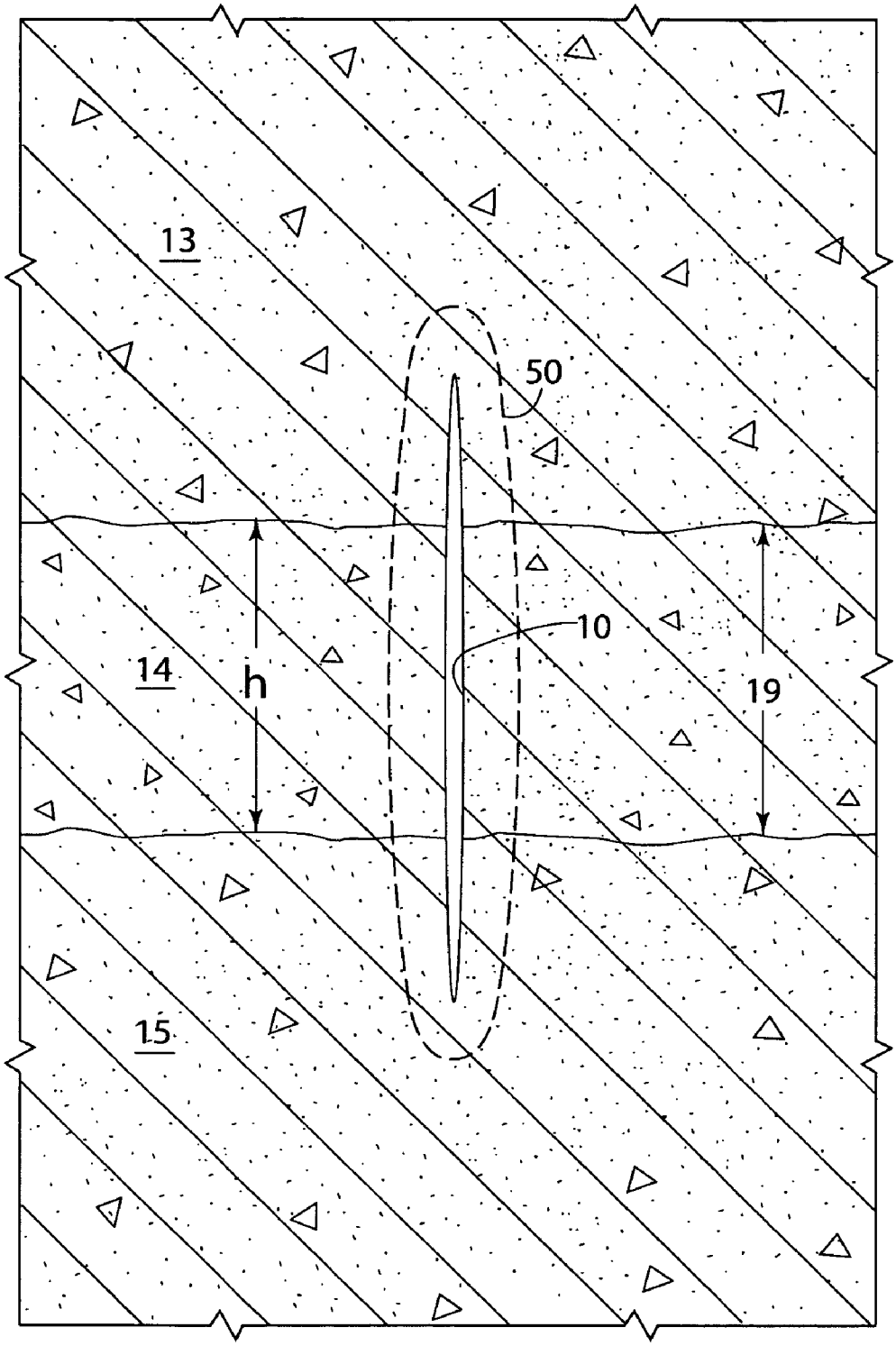
FIG. 6 is a cross-sectional elevation view of the localized geological area and main fracture of this invention taken along section line 6—6 of FIG. 1.

Essentially, as will be explained in more detail below, one or more smaller, in-situ stress-increasing fractures, e.g., fractures 20, 30 in FIG. 1, are created above and/or below the target interval of formation 14, which is to be deep fractured according to this invention. These smaller fractures 20, 30 create zones 22, 32 of increased in-situ stress around the small fractures 20, 30, and those increased in-situ stress zones 22, 32 restrict the main fracture zone 10 from propagating toward the locations of the smaller fracture zones 20, 30. Therefore, the hydraulic fluid pressure that creates the main fracture zone 10 causes the main fracture zone 10 to propagate farther into the target formation 14 rather than upwardly and/or downwardly into the increased in-situ stress fields 22, 32 of the smaller fractures 20, 30, respectively. Because these smaller fractures 20, 30 create the zones 22, 32 of increased in-situ stress that limit vertical growth of the main fracture 10, they are sometimes referred to in this description as "barrier fractures". As shown in FIGS. 1, 3, and 5, the barrier fractures 20, 32 are substantially coplanar with main fracture 50 so they can limit vertical growth of main fracture 50, as illustrated in FIGS. 1 and 5 adjacent the well 12.

In this art, where the fracture operations take place anywhere from 1,000 feet to over 20,000 feet below the surface of the ground, it is impossible for anyone to observe directly whatever actually occurs during and after a fracture operation. Therefore, even though countless studies have been done and hypotheses created over the years, and even with recent advances in geophysical instrumentations and visualization tools, it is still impossible to know exactly what the formation structures, stresses, material strengths, and other characteristics will be at any particular depth or location, let alone predict or describe exactly what actually happens during fracture operations in such formations, due to varying rock types, natural fractures and in-situ stresses, lithography changes, etc. Therefore, the descriptions herein and the accompanying drawings are necessarily idealized to some extent, and they include the inventor's hypotheses based on years of study, practical experience, and other publications with hypotheses of other experts trying to explain formation geophysics and fracturing operations. Consequently, some features and explanations of this invention are qualified by words, such as "substantially", "significant" or "idealistic", because it is impossible to put precise quantifications on them. In this context, "substantially" means in substance or in practical effect, even if not exact. For example, the claim in the preceding paragraph regarding the barrier fracture(s) being co-planar with the main fracture is idealized, when, in reality, the fractures themselves may have deviations and not be entirely in a plane, or planes of respective fractures may actually be somewhat parallel and off-set from each other by a few inches or a number of feet. However, if the respective stress zones 22, 50 or 32, 50 are aligned in such a way that the fracture(s) 20, 30 act as a barrier to vertical growth of the main fracture and cause it to grow instead farther into the target formation 14, then they are, in practical effect or substance, co-planar. Similarly, "significant" means that the features or effects are enough to be hypothesized, interpolated, extrapolated, or demonstrable with a hydraulic fracture simulator, at least to some extent by persons skilled in the art using results, inputs, or other observations that are understandable to persons skilled in the art, even if not precisely quantifiable or verifiable by direct observation or measurement. "Ideally" or "idealistic" means the best model or visualization, even though the reality may vary from that model or visualization.

With reference now primarily to FIG. 1 and with secondary references to FIGS. 2–6, a typical well bore 11 drilled into or through a target formation 14 is completed by setting a casing (pipe) 16 and circulating cement 18 into the annulus between the casing 16 and adjacent rock formations 13, 14, 15. After the cement 18 is cured, the casing 16 is perforated 42 in an interval 40 of the casing 16 that aligns with the target formation 14 (or with a particular target interval 19 of the target formation 14). Oil and/or gas from the target formation 14 can then flow from the target formation 14 through the perforations 42 into the casing 16, from where it can then either flow under reservoir pressure or be pumped to the surface of the ground. Conversely, in a fluid injection well, for example, the fluid can be pumped from the surface of the ground, through the casing 16, and into the target formation 14 via the perforations 42. Other techniques besides perforations 42 can be used to create fluid-flow communication between the well 12 and the target formation 14, which would also work for this invention. Regardless of the well 12 completion technique, if the target formation 14 is too tight, i.e., not permeable enough, to accommodate a sufficient flow rate of oil or gas through the target formation into the casing in an oil or gas well, or if the target formation 14 is too tight in a fluid injection well to receive and accommodate a sufficient flow rate of fluid from the casing 16 into the target formation 14, then fracturing the target formation 14 may be prescribed to improve such flow rates.

In this description, the target formation 14 is considered to be a geologic formation that is of interest, because it contains oil, gas, water, or some other mineral or material that is to be produced or because it is expected to receive injection of some fluid, such as water, for storage, disposal, secondary recovery water flood operations, or other beneficial purpose. The target interval 19 refers to a specific vertical height of the target formation 14 adjacent the well 12 to be perforated and/or fractured to access the target formation 14 for production of oil, gas, water, or other mineral or material from the target formation 14 or for injection of water, gas, oil, or other material into the target formation 14. Therefore, the target interval 19 may include the entire height of the target formation 14 adjacent the well 12 or only a portion of it, depending on the particular structure and circumstances at a particular well 12, which can and do vary widely. For example, in some circumstances it may be desirable to fracture a target interval 19 that extends the full height of the target formation 14, as illustrated in FIG. 1, whereas, in other circumstances it may be desirable to fracture only a target interval 19 of less than the entire height of the target formation 14, as illustrated for example in FIG. 9. Some factors in choosing a target interval 19 may include overall size of the target formation 14, permeability of the target formation 14, proximity of other formations and whether fluids from such formations can be mixed or must be kept separated, undesirable water in the target formation 14, and other factors that are known to persons skilled in the art. If there are nearby formations (not shown) that bear fluids, such as oil and/or gas, that can be mixed and produced together from the well 12, then the target interval 19 could even be larger than the full height of a particular target formation 14 and extend to the other nearby fluid-bearing formations as well.

Referring again primarily to FIG. 1, a preferred method of fracturing a target formation 14, or a particular target interval 19, according to this invention, is begun by perforating the casing 16 and cement 18 of the well 12 with two sets of perforated holes 52, 54 at some distances spaced, respectively, above and/or below the target formation 14 to be fractured. Then a fluid 56, such as a viscous liquid or a gas, depending on formation characteristics and fracture design criteria, is pumped through the casing 16 and into the formations 13, 15 above and below the target formation 14 at a sufficient pressure and flow rate to open and propagate the barrier fractures 20, 30. If the main perforations 42 have already been shot (perforated) before this operation to create the barrier fractures 20, 30 is started, then there is a choice of either initiating and propagating the main fracture 10 in the target formation 14 simultaneously with the barrier fractures 20, 30 or isolating or plugging the main perforations 42, while the barrier fractures 20, 30 are created. Also, the barrier fractures 20, 30 can be created simultaneously or sequentially with each other. Persons skilled in the art understand how perforations 42 can be isolated, e.g., by strategically placed packers (not shown), or plugged, e.g., by cement (not shown), to perform these operations, so no further description or explanation of isolating or plugging perforations 42 is necessary for an understanding of this invention. In typical hydraulic fracturing operations, the hydraulically induced fractures 10, 20, 30 extend in opposite directions from the well-bore 12, as illustrated in FIG. 1 and in FIGS. 2–6.

Figure 7:
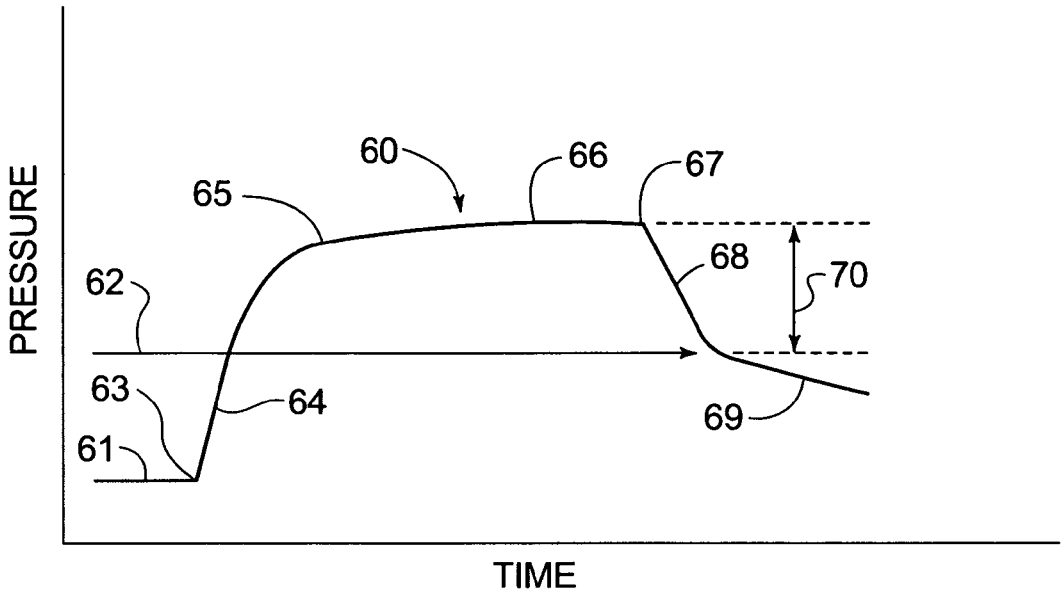
FIG. 7 is a graphical representation of a typical fracture fluid pressure curve to illustrate increased in-situ stress in a formation around a hydraulic fracture.

As mentioned above, the small, barrier fracture zones 20, 30 cause zones or envelopes of increased in-situ stress 22, 32 that surround the barrier fracture zones 20, 30, respectively. Such increased in-situ stress 22, 32 in the formations 13, 15 immediately adjacent the respective fractures 20, 30 is measurable during a hydraulic fracture operation, which is illustrated by a typical fluid pressure curve 60 in FIG. 7 for a typical fracture operation. In FIG. 7, the reservoir pressure 61 prior to the start of the fracture operation is level, of course, and is something less than the natural in-situ stress level 62. Then, as the fracture operation starts at 63, and the fracture fluid 56 (FIG. 1) is pumped into the formation being fractured, e.g., formation 13 and/or 15, the fluid injection pressure increases rapidly 64 (FIG. 7), past the natural in-situ stress level 62, to a fluid injection pressure region 65 that propagates the fracture, e.g., barrier fracture 20 and/or 30 (FIG. 1) in the formation, e.g., formation 13 and/or 15. As the fracture fluid continues to be injected into the formation 13 and/or 15 at rates high enough to continue propagating the fracture 20 and/or 30 farther into the formation 13 and/or 15, the fluid pressure character remains fairly constant, as shown at 66 in FIG. 5, depending to some extent on the particular fluid viscosity, fracture complexity, and pump rate at any particular time as well as on characteristics of the formation 13 and/or 15 as the fracture 20 and/or 30 propagates through it. Then, when the pumping is stopped 67, the fluid pressure declines 68 to the natural in-situ pressure 62 and continues decreasing 69 toward the reservoir pressure level 61 as the fracture fluid in the newly fractured zone leaks into the surrounding formation. The pressure difference 70 between the natural in-situ stress level 62 and the higher pressure level 66 during fracture propagation is called the "net fracturing pressure" and represents or approximates the increased in-situ stress adjacent the fracture 20 and/or 30. Since the pressure curve 60 in FIG. 7 is representative of typical fracture operations, such as those performed to create barrier fractures 20, 30 in FIG. 1, descriptions below referring to barrier fracture 20, increased in-situ stress zone 22 and formation 13 can be assumed to also apply to barrier fracture 30, increased in-situ stress zone 32, and formation 15 either singly or in combination so that the cumbersome "and/or" conjunctions do not have to be overused.

The increased in-situ stress 70 in FIG. 7 is indicative of the increased in-situ stress zones 22, 32 surrounding the barrier fractures 20, 30 in FIG. 1. Such increased in-situ stress in zones 22, 32 is highest immediately adjacent the fractures 20, 30 and decreases or fades toward the outer limits of the increased in-situ stress zones 22, 32. Therefore, these increased in-situ stress zones 22, 32 continue to exist as long as the fractures 20, 30 are held open. The fractures 20, 30 remain open, of course, during the fracture operation as the fracture fluid is being pumped into the fractured formation 13, 15, as explained above, but, unless the fracture 20, 30 is held open in some manner after the pumping is terminated, the increased in-situ stress zones 22, 32 will disappear as the pressure declines 68 (FIG. 7), as explained above.

This kind of fracture operation represented by the curve 60 in FIG. 7, in which the increased in-situ stress zone 22, 32 in FIG. 1 remains only as long as the fracture fluid is being pumped into the formation 13, 15, can be used to propagate the main fracture 10 farther into the target formation 14 according to this invention, if the barrier fractures 20, 30 are created and grown or propagated simultaneously with the creation and propagation of the main fracture 10. A preferred method of forming the barrier fractures 20, 30 simultaneously with the main fracture 10 is to direct more fluid volume into the main fracture 10 than into each respective barrier fracture 20, 30 by perforating the casing 16 with fewer holes 52, 54 for the barrier fractures 20, 30 as compared to more perforation holes 42 for the main fracture 10. The number of perforation holes 42 into the target formation 14 in relation to the respective numbers of perforation holes 52, 54 into adjacent formations 13, 15 can be proportioned to achieve any desired proportional flow rates and volumes of fluids into the respective main fracture zone 10 and barrier fracture zones 20, 30 by persons skilled in the art, because the perforation hole sizes and the fluid pressures at the respective perforation intervals 40, 52, 54 can be easily determined and/or designed.

For example, the reservoir pressure 61 and the natural in-situ stresses 62 (FIG. 7) of the target formation 14 and the adjacent formations 13, 15 (FIG. 1) are usually either known, measurable, or can be estimated with reasonable accuracy, and the fluid pressures and flow rates required to open and propagate the respective fractures 10, 20, 30 can also be determined with reasonable accuracy by persons skilled in the art. With these parameters, the respective fluid pressures and cross-sectional areas provided by the perforation holes 42, 52, 54 needed at the respective perforation intervals to open and propagate the desired sizes of perforation zones 10, 20, 30 can be determined. As mentioned above, this approach may be designed to have lower fracture fluid injection rates and volumes into the adjacent formations 13, 15 to create the barrier fractures 20, 30, while higher injection rates and more fluid volume are directed into the target interval 19 to create the larger main fracture zone 10. Under this scenario, the perforated adjacent formations 13, 15 above and below the perforated target formation 14 are expected to hydraulically fracture at about the same time as the target formation 14, but the barrier fractures 20, 30 in the adjacent formations 13, 15 are expected to propagate and to not get as large as the main fracture 10. However, these barrier fractures 20, 30 in the adjacent formations 13, 15 increase the in-situ stresses around them and inhibit vertical growth of the main fracture 10 to thereby promote more lateral propagation of the main fracture 10 farther into the target formation 14, as explained above.

In the alternative, the barrier fractures 20, 30 can be created first, before the main fracture 10, and they can be kept open by packing solid materials into the barrier fractures 20, 30 (FIG. 1) before the pumping is terminated 67 (FIG. 7) in order to maintain the increased in-situ stress zones 22, 32 around the barrier fractures 20, 30 (FIG. 1) after the pumping of the fracture fluid into the barrier fracture zones 20, 30 is stopped. Such materials (not shown) that would keep a fracture open, for example, proppant, cement, sand and/or synthetic beads or other materials as well as methods of placing them in the fractures, are well-known to persons skilled in the art and need not be described in more detail here for an understanding of this invention. See, for example, U.S. Pat. No. 5,531,274 issued to R. Bienvenu, Jr. Then, with the barrier fractures 20, 30 propped open to maintain the increased in-situ stress zones 22, 32 (FIG. 1) around the barrier fractures 20, 30, the perforations 52, 54 into those barrier fracture zones 20, 30 can be isolated or plugged, the casing 16 can be perforated 42 into the target formation 14, if such perforations 42 have not been created previously, and all of the fracture fluid in the next step can then be pumped through the perforations 42 into the target interval 19 to open and propagate the main fracture zone 10.

Figure 2:
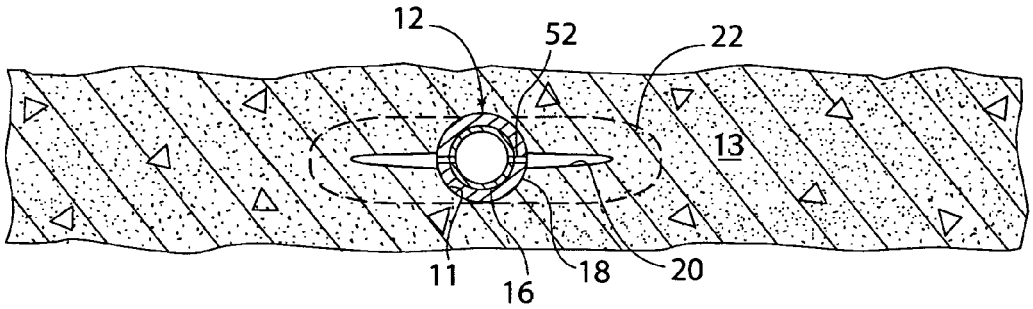
FIG. 2 is cross-sectional, top plan view of the localized geological area around the well taken along section line 2—2 of FIG. 1.

It is preferred that the perforations 52, 54 are positioned far enough from the target interval 19, and that the barrier fracture zones 20, 30 be designed in size, such that the zones of increased stress 22, 32 do not extend to a substantial degree into, thus have no significant effect on, the target interval 19 (See FIGS. 1, 2, and 5). Consequently, initiation of the main fracture zone 10 in the target interval 19 is not inhibited by the increased stress zones 22, 32, and the orientation of the main fracture zone 10 near the well 12 during initiation is not affected or altered by the increase stress zones 22, 32. However, as the main fracture 10 grows far enough vertically, i.e., upwardly and/or downwardly, as illustrated in FIGS. 1 and 5, either it or its own zone of increased stress 50 eventually encounters the increased stress zones 22, 32 around the barrier fractures 20, 30, as illustrated in FIGS. 1 and 5, which inhibit further growth of the main fracture 10 in those vertical directions and promotes additional growth of the main fracture zone 10 farther outward from the well 12 into the target formation 14, as shown in FIGS. 1, 4, 5, and 7.

The vertical growth-inhibiting effect of the increased stress zones 22, 32 on the main fracture zone 10 is believed to be due to the increase in in-situ stresses 70 (FIG. 7) that occurs when the barrier fracture 20, 30 is kept open by either continued injection or packing material (not shown) in the barrier fracture 20, 30, as discussed above. The main fracture 10 propagating within the target interval 19 will tend to grow farther outward from the well 12 toward the unaffected stress region 101 (FIG. 1) rather than into the higher stress fields 22, 32 that exist around the barrier fractures 20, 30. Therefore, following in the path of least resistance, the main fracture 10 grows less within the increased stress zones 22, 32 and, instead, propagates farther into target formation 14, as illustrated in FIGS. 1, 3, 4, 5, and 6. For comparison, a conventional main fracture zone 100 of about the same size in fracture fluid volume, pressure, and pump rate, but without the benefit of the barrier fractures 20, 30, is shown in phantom lines on FIG. 1.

Figure 8:
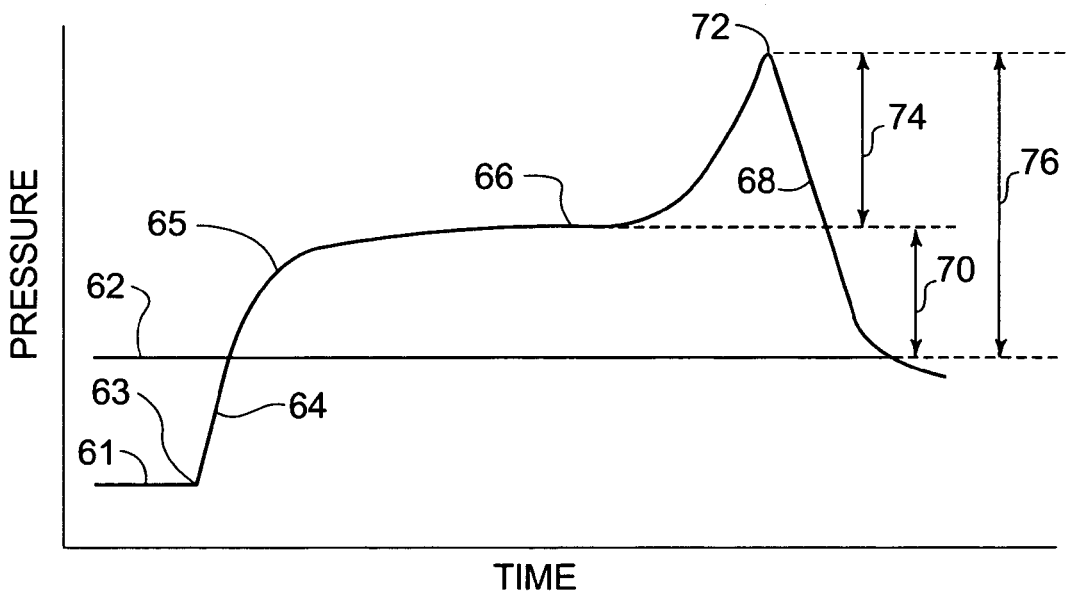
FIG. 8 is a graphical representation of a typical fracture fluid pressure curve for a fracture operation that includes a squeeze operation near the end of the fracture operation.

In an alternative embodiment, the in-situ stress in zones 22, 30 around the barrier fractures 20, 30 can be increased even further by what is known as a squeeze operation, i.e., packing a material into the barrier fractures 20, 30 at a pressure 72 (see FIG. 8) that is higher than the typical pressure 66 needed to open and sustain fracture width in those formations 13, 15. As illustrated in FIG. 8, the initial portion of the pressure vs. time curve 66 for a squeeze type of fracture operation is similar to the conventional pressure vs. time curve 60 in FIG. 7 and described above. In other words, the curve 60 begins at the reservoir pressure 61, but increases 64 as soon as the injection of fracture fluid into the formation 13, 15 starts. Then as the fracture 20, 30 propagates into the formation 13, 15 the pressure vs. time curve 60 becomes consistent 66. Near the end of the fracturing operation, however, a fine material, such as proppant, cement, synthetic beads, fine grained rock, or the like, can be injected with liquid into the barrier fracture 20, 30 to build friction in the fracture and higher fluid pressure which increases the fracture width and allows the fracture to be packed even wider with the solid material, thereby keeping the fracture 20, 30 open wider and thus causing a higher pressure 72 and increase in the in-situ stress 74. The difference 70 between the natural in-situ stress pressure 62 and the conventional fracture pressure 66 represents or approximates the typical increased in-situ stress during the fracture propagation phase of the operation, as explained above, while the difference 74 between the conventional fracture pressure 66 and the peak pressure 72 represents or approximates the additional increased in-situ stress added to the formation 13, 15 surrounding the fracture 20, 30 by the squeeze operation at the end of the fracture operation. Therefore, the difference 76 between the natural in-situ stress 62 and the peak pressure 72 represents or approximates the total increased in-situ stress 76 in the increased in-situ stress zone 22, 32 surrounding the barrier fractures 20, 30, when a squeeze operation is included at the end of a fracture operation, as described above. Of course, to maintain such increased in-situ stress 76, the fracture must be kept open, maintaining the width, which can be done with the proppant, cement, synthetic materials, fine grained rock, or other fine material used to pack open the fracture 20, 30 and maintain it open or with a combination of the proppant, cement, synthetic material, fine grained rock, or other fine material and a courser proppant or other material that, when pumped and packed into the barrier fracture 20, 30 either before or during the squeeze operation, helps to maintain the barrier fracture 20, 30 width after the fracture operation ends.

In the descriptions above, the fracture operations with or without the squeeze operation are applicable to either one or both of the barrier fractures 20, 30, regardless of whether the description referred to one or both of them. They are also applicable, regardless of whether a particular application uses only one such barrier fracture either above or below the target interval 19 or even more than two of such barrier fractures and regardless of whether one or more of such small fractures 20, 30 is or are positioned in adjacent formations 13, 15, as illustrated in FIG. 1, or positioned in the target formation 14.

Figure 9:
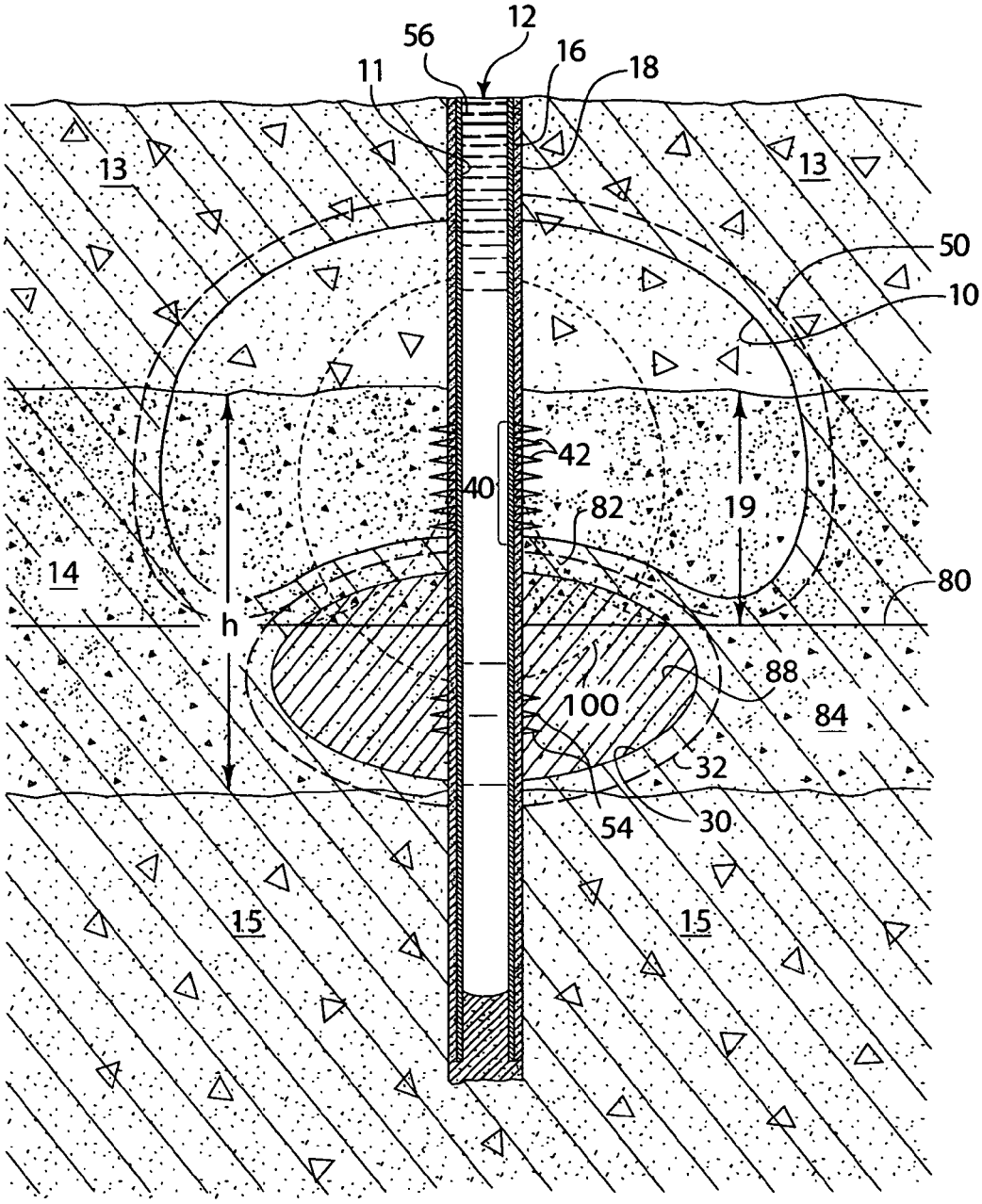
FIG. 9 is a diagrammatic, cross-sectional view of a localized geological formation around a well, similar to FIG. 1, but wherein the target formation includes a water-bearing zone and a barrier fracture is used to inhibit main fracture growth into the water zone according to this invention.

For example, as illustrated in FIG. 9, it is not uncommon for a target oil and/or gas bearing formation 14 to also contain a substantial amount of water, which, because of differences in density, usually underlays the oil and/or gas in the target formation 14, but can also exist above the target formation 14. However, even when the casing 16 is perforated only into a target interval 19 of the target formation 14 above the water level 80, it is not uncommon for the target formation 14 to require fracture stimulation to attempt to achieve commercial producing rates. However, it is common for a conventional fracture geometry (shown in phantom line 100 in FIG. 9) for such stimulation of the target interval 19 to also grow into the water bearing portion 84 of the target formation 14. Substantial amounts of the water can be drawn 82 upwardly to the perforations 42 to be produced from the well 12 along with the oil and/or gas. Such water production from an oil and/or gas well is undesirable, because it can inhibit full producing rate of oil and/or gas from the hydrocarbon zone 86. It is also a nuisance, not only because the water has to be separated from the oil and/or gas produced from the well 12, but also because it can contaminate soil and fresh water on the surface of the ground, thus presents a disposal problem. Therefore, when a fracture operation to stimulate production of the oil and/or gas from the target formation 14 also extends inadvertently into the water-bearing zone 84 of the target formation 14, the water production problem can be exacerbated.

However, as illustrated in FIG. 9, a barrier fracture 30 placed strategically in the water-bearing zone 84 of a target formation 14 below the target interval 19 in the oil and/or gas bearing zone 86 can be used to inhibit vertical growth of the main fracture 10 into the water-bearing zone 84 according to this invention. As described above, the zone 32 of increased in-situ stress surrounding the barrier fracture 30 will inhibit vertical growth of the main fracture 10 into the water-bearing zone 84 and induce it to propagate laterally and upwardly instead. The barrier fracture 30 shown in FIG. 9 can either be plugged or squeezed, such as with cement or other nonporous material 88 to inhibit even easier water coning and production via the barrier fracture 30, especially if the barrier fracture 30 is created before the main fracture 10.

Such barrier fractures 20, 30, can be created by any of the methods described above, and, one or more additional barrier fractures and/or main fractures can also be used for variations of these applications, as will be understood by persons skilled in the art after learning the principles of this invention.

The foregoing description is considered as illustrative of the principles of the invention. Furthermore, since numerous modifications and changes will readily occur to those skilled in the art, it is not desired to limit the invention to the exact construction and process shown and described above. Accordingly, resort may be made to all suitable modifications and equivalents that fall within the scope of the invention. The words "comprise," "comprises," "comprising," "include," "including," and "includes" when used in this specification are intended to specify the presence of stated features, integers, components, or steps, but they do not preclude the presence or addition of one or more other features, integers, components, steps, or groups thereof.

The invention claimed is:

1. A method of fracturing a target interval of a target geological formation that is penetrated by a well, comprising:

creating a zone of increased in situ stress a vertical distance from the target interval by creating a vertical barrier fracture that extends diametrically outward from the well at a vertical distance from the target interval so that the zone of increased in situ stress extends toward the target interval; and holding the barrier fracture open to maintain the zone of increased in situ stress while creating a vertical main fracture in the target interval by hydraulically fracturing the target interval with more fracture fluid than is needed to propagate the main fracture vertically to an extent that the zone of increased in situ stress inhibits further growth of the main fracture toward the barrier fracture and continuing to propagate the main fracture to cause additional growth of the main fracture farther diametrically outward from the well than the barrier fracture.

2. The method of claim 1, including creating the zone of increased in situ stress above the target interval.

3. The method of claim 1, including creating the zone of increased in situ stress below the target interval.

4. The method of claim 1, including creating the zone of increased in situ stress above the target interval and creating a second zone of increased in situ stress below the target interval.

5. The method of claim 1, including creating the zone of increased in situ stress by creating a barrier fracture in a formation located vertically from the target interval.

6. The method of claim 5, including creating the barrier fracture by hydraulically fracturing the formation located vertically from the target interval.

7. The method of claim 6, including hydraulically fracturing the formation located vertically from the target interval with enough fluid at a sufficient rate and pressure to extend the barrier fracture vertically toward the target interval until the zone of increased in situ stress is positioned at a desired vertical growth limit for the main fracture.

8. The method of claim 7, including creating the barrier fracture and the main fracture simultaneously.

9. The method of claim 7, including creating the barrier fracture with the zone of increased in situ stress before creating the main fracture.

10. The method of claim 1, wherein the target interval includes substantially all of the target geological formation adjacent the well, and the zone of increased in situ stress is created in a different geological formation vertically adjacent the target formation.

11. The method of claim 1, wherein the target interval includes a portion of the target formation adjacent the well, and the zone of increased in situ stress is created in a different geological formation vertically adjacent the target formation.

12. A method of fracturing a target interval of a target geological formation, comprising:

perforating a well that penetrates the target geological formation to have a main set of perforation holes into the target interval and to have another set of perforation holes located vertically from the target interval in such a manner that said main set of perforation holes has more cross-sectional area that said another set of perforation holes;

simultaneously creating a main fracture in the target interval and a barrier fracture smaller than the main fracture a vertical distance from the target interval by pumping enough fluid at a sufficient rate into the well and out of both said main set of perforation holes and said another set of perforation holes to create and propagate said main fracture and said barrier fracture diametrically outward from the well and vertically enough for the baffler fracture to create a zone of increased in situ stress that inhibits the vertical propagation of the main fracture and thereby enhances the diametric outward propagation of the main fracture.

13. The method of claim 12 wherein the cross-sectional area of said main set of perforation holes is proportioned in relation to the cross-sectional area of said another set of perforation holes such that the zone of increased in situ stress around the barrier fracture reaches a desired vertical growth limit for the main fracture at least as soon as the main fracture reaches said desired vertical growth limit to inhibit further vertical growth of the main fracture.

14. The method of claim 12, including placing said another set of perforation holes vertically below said main set of perforation holes.

15. The method of claim 14, including:

also perforating the well with an additional set of perforation holes a vertical distance above said main set of perforation holes in such a manner that said main set of perforation holes has more cross-sectional area that said another set of perforation holes; and simultaneously creating said main fracture, said another fracture vertically below said main fracture, and an additional fracture vertically above said main fracture, said additional fracture also being smaller that the main fracture, by pumping enough of the fluid at a sufficient rate into the well and out of both said main set of perforation holes and said another set of perforation holes as well as out of additional set of perforation holes to create and propagate said main fracture as well as both of said barrier fractures diametrically outward from the well and vertically enough for the baffler fractures to create respective zones of increased in situ stress that inhibit the vertical propagation of the main fracture and thereby enhance the diametric outward propagation of the main fracture.

16. The method of claim 14, including placing said another set of perforation holes vertically above said main set of perforation holes.

17. A method of fracturing a target interval of a target geological formation that is penetrated by a well, comprising:

creating a zone of increased in situ stress a vertical distance from the target interval by creating a baffler fracture that extends diametrically outward from the well at a vertical distance from the target interval so that the zone of increased in situ stress extends toward the target interval, including performing a squeeze operation in the barrier fracture to further increase in situ stress in the zone of increased in situ stress; and creating a vertical main fracture in the target interval by hydraulically fracturing the target interval with more than enough fracture fluid to propagate the main fracture vertically to an extent that the zone of increased in situ stress inhibits further growth of the main fracture toward the baffler fracture while directing additional growth of the main fracture farther diametrically outward from the well than the barrier fracture.

18. A method of fracturing a target interval in an oil and/or gas-bearing zone of a target geological formation, wherein the target geological formation also has a water-bearing zone vertically adjacent the oil an/or gas-bearing zone and is penetrated by a well, comprising:

creating a zone of increased in situ stress in the water-bearing zone by creating a barrier fracture in the water-bearing zone that extends diametrically outward from the well at a vertical distance from the target interval so that the zone of increased in situ stress extends toward the target interval; and creating a vertical main fracture in the target interval by hydraulically fracturing the target interval with more than enough fracture fluid to propagate the main fracture vertically to an extent that the zone of increased in situ stress inhibits further growth of the main fracture toward the barrier fracture and thereby causes additional growth of the main fracture farther diametrically outward from the well than the barrier fracture.

19. The method of claim 18, wherein the water-bearing zone in the target formation is below the oil and/or gas-bearing zone.

20. The method of claim 18, wherein the water-bearing zone in the target formation is above the oil and/or gas-bearing zone.

21. A method of fracturing a target interval in an oil and/or gas-bearing zone of a target geological formation, that is vertically adjacent a water-bearing zone in a different geological formation and which is penetrated by a well, comprising:

creating a zone of increased in situ stress in the water-bearing zone by creating a barrier fracture in the water-bearing zone that extends diametrically outward from the well at a vertical distance from the target interval so that the zone of increased in situ stress extends toward the target interval; and creating a vertical main fracture in the target interval by hydraulically fracturing the target interval with more than enough fracture fluid to propagate the main fracture vertically to an extent that the zone of increased in situ stress inhibits further growth of the main fracture toward the barrier fracture and thereby causes additional growth of the main fracture farther diametrically outward from the well than the barrier fracture.

22. The method of claim 21, wherein the water-bearing zone in the different geological formation is below the oil and/or gas-bearing zone.

23. The method of claim 21, wherein the water-bearing zone in the different geological formation is above the oil and/or gas-bearing zone.

24. A method of fracturing a target interval of a target geological formation that is penetrated by a well, comprising:

creating a zone of increased in situ stress a vertical distance from the target interval by creating a vertical barrier fracture that extends diametrically outward from the well at a vertical distance from the target interval so that the zone of increased in situ stress extends toward the target interval;

holding the barrier fracture open to maintain the zone of increased in situ stress while creating a vertical main fracture in the target interval by hydraulically fracturing the target interval with at least enough fracture fluid to propagate the main fracture vertically to an extent that the zone of increased in situ stress inhibits further growth of the main fracture toward the barrier fracture; and continuing to pump additional fracture fluid into the main fracture while the zone of increased in situ stress inhibits further growth of the main fracture toward the barrier fracture, thereby causing the main fracture to grow farther diametrically outward from the well than the barrier fracture.

25. A method of fracturing a target interval of a target geological formation that is penetrated by a well, comprising:

creating a first zone of increased in situ stress a vertical distance below the target interval by creating a first vertical barrier fracture that extends diametrically outward from the well at a vertical distance below the target interval so that the first zone of increased in situ stress extends toward the target interval;

creating a second zone of increased in situ stress a vertical distance above the target interval by creating a second vertical barrier fracture that extends diametrically outward from the well at a vertical distance above the target interval so that the second zone of increased in situ stress extends toward the target interval;

holding the first and second vertical barrier fractures open to maintain the first and second zones of increased in situ stress while creating a main fracture in the target interval by hydraulically fracturing the target interval with at least enough fracture fluid to propagate the main fracture vertically downward and vertically upward to an extent that the first and second zones of increased in situ stress inhibit further growth of the main fracture toward the first and second barrier fractures; and continuing to pump additional fracture fluid into the main fracture while the first and second zones of increased in situ stress inhibit further growth of the main fracture toward the first and second barrier fractures to thereby cause the main fracture to grow farther diametrically outward from the well than the first and second barrier fractures.

* * * * *